US011752765B2

(12) United States Patent
Kawamata et al.

(10) Patent No.: US 11,752,765 B2
(45) Date of Patent: Sep. 12, 2023

(54) LIQUID DISCHARGE HEAD AND RECORDING DEVICE

(71) Applicant: KYOCERA CORPORATION, Kyoto (JP)

(72) Inventors: Shuhei Kawamata, Kirishima (JP); Masaru Iwabuchi, Kirishima (JP)

(73) Assignee: KYOCERA CORPORATION, Kyoto (JP)

( * ) Notice: Subject to any disclaimer, the term of this patent is extended or adjusted under 35 U.S.C. 154(b) by 161 days.

(21) Appl. No.: 17/427,094

(22) PCT Filed: Jan. 30, 2020

(86) PCT No.: PCT/JP2020/003569
§ 371 (c)(1),
(2) Date: Jul. 30, 2021

(87) PCT Pub. No.: WO2020/158905
PCT Pub. Date: Aug. 6, 2020

(65) Prior Publication Data

US 2022/0118764 A1 Apr. 21, 2022

(30) Foreign Application Priority Data

Jan. 31, 2019 (JP) ..... 2019-016188

(51) Int. Cl.
*B41J 2/14* (2006.01)
*B41J 2/165* (2006.01)

(52) U.S. Cl.
CPC ..... *B41J 2/14209* (2013.01); *B41J 2/16505* (2013.01); *B41J 2002/14241* (2013.01); *B41J 2002/14491* (2013.01); *B41J 2202/08* (2013.01)

(58) Field of Classification Search
CPC ..... B41J 2/14209; B41J 2/16505; B41J 2002/14241; B41J 2002/14491; B41J 2202/08
See application file for complete search history.

(56) References Cited

U.S. PATENT DOCUMENTS

| | | | |
|---|---|---|---|
| 2007/0242109 A1 | 10/2007 | Ito | |
| 2008/0079782 A1 | 4/2008 | Taira | |
| 2015/0321474 A1 | 11/2015 | Ichizono | |
| 2018/0029395 A1 | 2/2018 | Sugiura et al. | |

FOREIGN PATENT DOCUMENTS

| | | | |
|---|---|---|---|
| JP | 201291510 A | 5/2012 | |
| JP | 2013139157 A | 7/2013 | |
| JP | 5822624 | * 11/2015 | ..... B41J 2/01 |
| JP | 2015223805 A | 12/2015 | |
| JP | 2016147498 A | 8/2016 | |
| JP | 201815967 A | 2/2018 | |
| WO | 2014104109 A | 7/2014 | |

* cited by examiner

*Primary Examiner* — Geoffrey S Mruk
(74) *Attorney, Agent, or Firm* — HAUPTMAN HAM, LLP

(57) ABSTRACT

A liquid discharge head according to an embodiment includes a head body having a first surface configured to discharge a liquid and a second surface facing the first surface, a drive IC configured to drive the head body, and a head cover configured to cover at least the second surface of the head body while housing the drive IC. The head cover includes a top plate facing the second surface of the head body and a first side plate that is connected to the top plate and that is in contact with the drive IC, and in the head cover, a thickness of the first side plate is thinner than a thickness of the top plate.

16 Claims, 13 Drawing Sheets

LIQUID DISCHARGE HEAD AND RECORDING DEVICE

RELATED APPLICATIONS

The present application is a National Phase of International Application No. PCT/JP2020/003569, filed Jan. 30, 2020, and claims priority based on Japanese Patent Application No. 2019-016188, filed Jan. 31, 2019.

TECHNICAL FIELD

The disclosed embodiments relate to a liquid discharge head and a recording device.

BACKGROUND ART

Inkjet printers and inkjet plotters that utilize inkjet recording methods are known as printing apparatuses. In recent years, inkjet recording systems have also been widely used in industrial applications such as forming electronic circuits, manufacturing color filters for liquid crystal displays, manufacturing organic EL displays, and the like.

In such inkjet printing apparatuses, a liquid discharge head for discharging liquid is mounted. A thermal method and a piezoelectric method are commonly known in this type of liquid discharge head. The liquid discharge head of the thermal method includes a heater as a pressurizing means in an ink channel, heats and boils ink by using the heater, and pressurizes and discharges the ink by air bubbles generated in the ink channel. The liquid discharge head of the piezoelectric type causes a wall of a part of the ink channel to be bent and displaced by a displacement element to mechanically pressurize and discharge the ink in the ink channel.

In addition, examples of such a liquid discharge head include a serial type that performs recording while the liquid discharge head is being moved in a direction (main scanning direction) orthogonal to a transport direction (sub-scanning direction) of a recording medium, and a line type that performs recording on a recording medium transported in the sub-scanning direction in a state where the liquid discharge head, which is longer than the recording medium in the main scanning direction, is fixed. The line type has an advantage that high-speed recording is possible because there is no need to move the liquid discharge head, unlike the serial type.

Such a liquid discharge head includes a head body, a drive IC configured to drive the head body, and a head cover configured to cover at least a part of the head body while housing the drive IC. In addition, in the liquid discharge head, heat generated by the drive IC is released by being brought into contact with an inner surface of the head cover covering the head body, the drive IC being housed in the head cover. The thickness of a top plate and a side plate of such a head cover is constant (see, for example, Patent Document 1).

CITATION LIST

Patent Literature

Patent Document 1: WO 2014/104109

SUMMARY OF INVENTION

Technical Problem

Now, in order to improve heat radiating properties in the liquid discharge head, it is conceivable to reduce a thickness of the head cover. However, in the liquid discharge head described in Patent Document 1, the thickness of the top plate and the side plate of the head cover is constant, and thus, for example, when the thickness of the side plate is reduced in order to improve the heat radiating properties of the top plate and the side plate, the strength of the head cover may decrease.

An aspect of an embodiment has been made in view of the above-described problem, and an object thereof is to provide a liquid discharge head and a recording device that are capable of suppressing a decrease in strength of a head cover while improving heat radiating properties.

Solution to Problem

A liquid discharge head according to an aspect of an embodiment includes a head body having a first surface configured to discharge a liquid and a second surface facing the first surface, a drive IC configured to drive the head body, and a head cover configured to cover at least the second surface of the head body while housing the drive IC, wherein the head cover includes a top plate facing the second surface of the head body and a first side plate that is connected to the top plate and that is in contact with the drive IC, and, in the head cover, a thickness of the first side plate is thinner than a thickness of the top plate.

Advantageous Effects of Invention

According to an aspect of an embodiment, it is possible to suppress a decrease in strength of the head cover while improving heat radiating properties.

DESCRIPTION OF EMBODIMENTS

Embodiments of a liquid discharge head and a recording device disclosed in the present application will be described in detail below with reference to the accompanying drawings. Note that the present invention is not limited to the embodiments that will be described below.

<Overview of Recording Device 1>

Figure 1A:
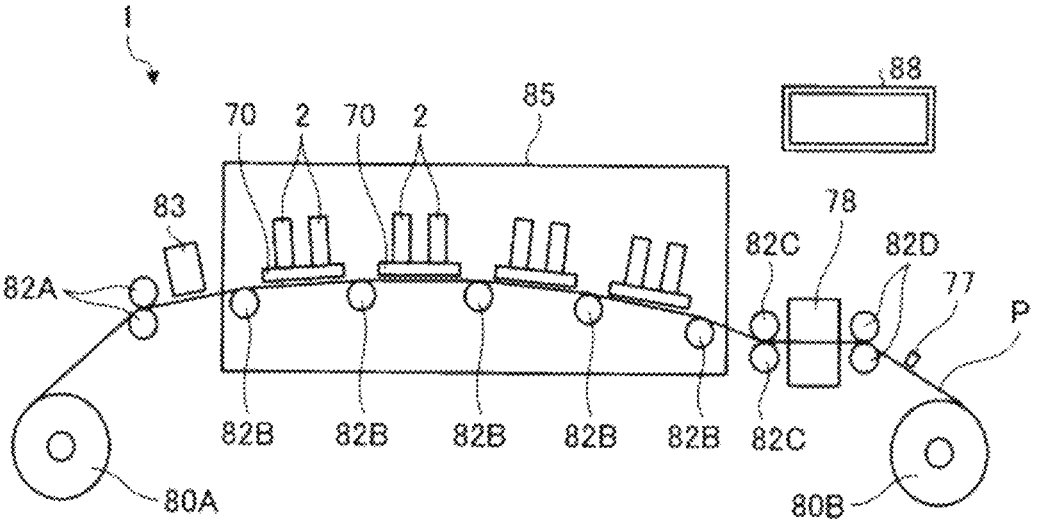
FIG. 1A is an explanatory diagram (1) of a recording device according to an embodiment.
Figure 1B:
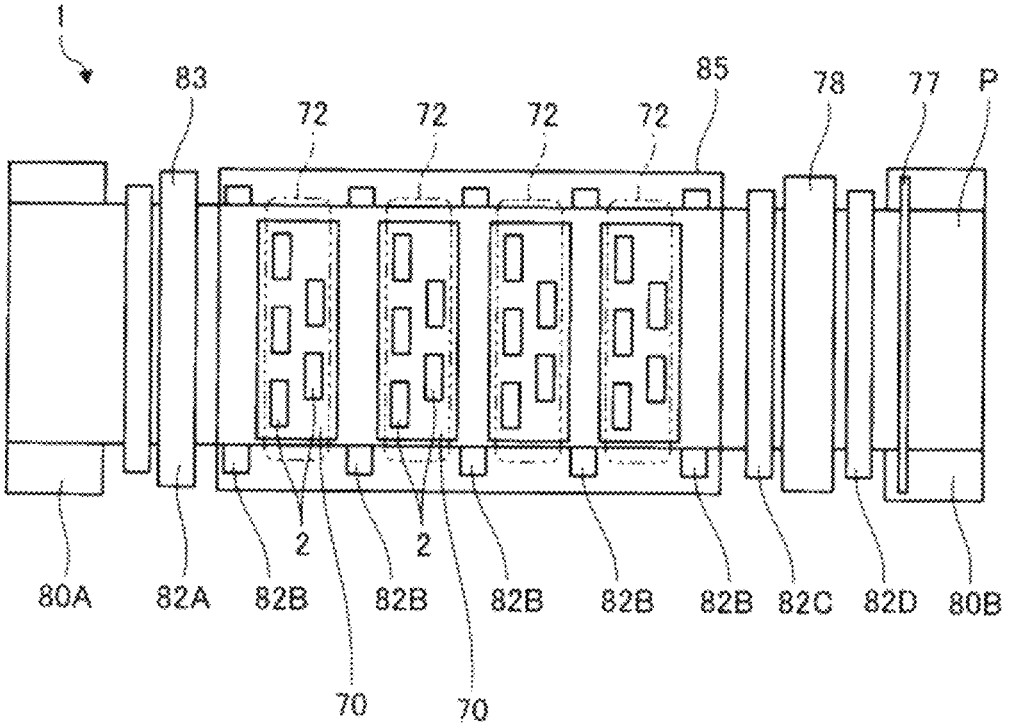
FIG. 1B is an explanatory diagram (2) of the recording device according to an embodiment.

First, an overview of a recording device (hereinafter, referred to as a printer) 1 according to an embodiment will be described with reference to FIG. 1A and FIG. 1B. FIG. 1A and FIG. 1B are explanatory diagrams of the printer 1 according to an embodiment. Specifically, FIG. 1A is a schematic side view of the printer 1 and FIG. 1B is a schematic plan view of the printer 1. Note that in FIG. 1A and FIG. 1B, a color inkjet printer is illustrated as an example of the printer 1.

As illustrated in FIG. 1A and FIG. 1B, the printer 1 transports printing paper P from guide rollers 82A to transport rollers 82B. The printing paper P moves relative to a liquid discharge head 2. A control unit 88 controls the liquid discharge head 2 based on image and character data, and discharges liquid toward the printing paper P. By landing droplets on the printing paper P, the printer 1 records images and characters on the printing paper P. A distance between the liquid discharge head 2 and the printing paper P is, for example, approximately 0.5 mm to 20 mm.

In the present embodiment, the liquid discharge head 2 is fixed to the printer 1, and the printer 1 is a so-called line printer. Note that other forms of the printer 1 include so-called serial printers in which an operation of moving the liquid discharge head 2 and recording by causing the liquid discharge head 2 to reciprocate in a direction intersecting the transport direction of the printing paper P, for example, in a substantially orthogonal direction, and transport of the printing paper P are alternately performed.

The liquid discharge head 2 has a shape extending in a depth direction from the illustrated surface according to FIG. 1A and extending in a vertical direction according to FIG. 1B, and the extending direction may be described below as a longitudinal direction. In the example illustrated in FIG. 1B, in the printer 1, a plurality of liquid discharge heads 2 are disposed. The liquid discharge head 2 is positioned such that the longitudinal direction of the liquid discharge head 2 is orthogonal to the transport direction of the printing paper P, and a head group 72 is constituted by five liquid discharge heads 2. FIG. 1B illustrates an example in which three liquid discharge heads 2 are positioned frontward in the transport direction of the printing paper P, and two liquid discharge heads 2 are positioned rearward in the transport direction of the printing paper P, and respective centers of the liquid discharge heads 2 are positioned so as not to overlap with each other in the transport direction of the printing paper P.

The five liquid discharge heads 2 constituting the head group 72 are fixed to a frame 70 having a flat plate shape. The frame 70 having the flat plate shape is also positioned such that the longitudinal direction of the frame 70 is orthogonal to the transport direction of the printing paper P. In FIG. 1B, an example is illustrated in which the printer 1 includes four head groups 72.

The four head groups 72 are positioned along the transport direction of the printing paper P. Liquid, for example, ink, is supplied to each of the liquid discharge heads 2 from a liquid tank (not illustrated). The liquid discharge heads 2 belonging to one head group 72 are supplied with ink having the same color, and four colors of ink can be printed by using the four head groups 72. The colors of the ink discharged from the respective head groups 72 are, for example, magenta (M), yellow (Y), cyan (C), and black (K). In a case where such ink is controlled by the control unit 88 and printing is performed, a color image can be printed. In addition, liquid such as a coating agent may be printed in order to perform surface treatment of the printing paper P.

The number of the liquid discharge heads 2 mounted in the printer 1 may be one in a case where a single color is used and printing is performed within a range capable of being printed by one liquid discharge head 2. The number of the liquid discharge heads 2 included in the head group 72 and the number of the head groups 72 can be appropriately changed depending on an object to be printed and printing conditions.

The printing paper P is wound on a paper feed roller 80A before use, and after passing between the two guide rollers 82A, the printing paper P passes under the plurality of frames 70, passes between two transport rollers 82C and 82D, and is finally collected by a collection roller 80B.

In addition to the printing paper P, cloth in a rolled state or the like may be used as a printing target. Furthermore, instead of directly transporting the printing paper P, the printer 1 may have a configuration in which the printing paper P is put on a transport belt and transported. By using the transport belt, the printer 1 can perform printing on a sheet of paper, a cut cloth, wood, a tile, or the like as a printing target. In addition, a wiring pattern or the like of electronic equipment may be printed by discharging liquid containing electrically conductive particles from the liquid discharge head 2. In addition, chemicals may be produced by discharging a chemical agent that is a predetermined amount of liquid or liquid containing a chemical agent from the liquid discharge head 2 toward a reaction vessel or the like.

The printer 1 includes a coating applicator 83. The coating applicator 83 is controlled by the control unit 88, and uniformly applies a coating agent to the printing paper P. Thereafter, the printing paper P is transported under the liquid discharge head 2.

The printer 1 includes a head case 85 that houses the liquid discharge head 2. The head case 85 is connected to the outside in a part of a portion where the printing paper P enters and exits or the like, but is a space substantially separated from the outside. As necessary, for the head case 85, control factors (at least one) such as temperature, humidity, air pressure and the like are controlled by the control unit 88 and the like.

The printer 1 includes a dryer 78. The printing paper P moving out from the head case 85 passes between the two transport rollers 82C and passes inside the dryer 78. By drying the printing paper P by the dryer 78, the printing paper P that is overlapped and wound is adhered to itself at the collection roller 80B, and it is difficult for the undried liquid to be rubbed.

The printer 1 includes a sensor unit 77. The sensor unit 77 is configured by a position sensor, a speed sensor, a temperature sensor, or the like. The control unit 88 may determine a status of each portion of the printer 1 from information from the sensor unit 77 to control each portion of the printer 1.

The printer 1 may include a cleaning unit configured to clean the liquid discharge head 2. The cleaning unit performs cleaning by wiping or capping, for example. For example, by rubbing a surface of a portion from which liquid is to be discharged, for example, a discharge hole surface 4A (see FIG. 2) of the liquid discharge head 2 by using a flexible wiper, wiping removes liquid that has been attached to the surface.

The cleaning by the capping will be done as follows, for example. First, the portion where liquid is to be discharged, for example, the discharge hole surface 4A, is covered with a cap (this is referred to as capping), and the discharge hole surface 4A and the cap create a substantially sealed space. By repeating discharge of liquid in such a state, liquid having viscosity higher than that of the standard state, foreign matters, and the like that have become clogged in the discharge hole 8 (see FIG. 3, and the like) are removed.

<Liquid Discharge Head 2>

Figure 2:
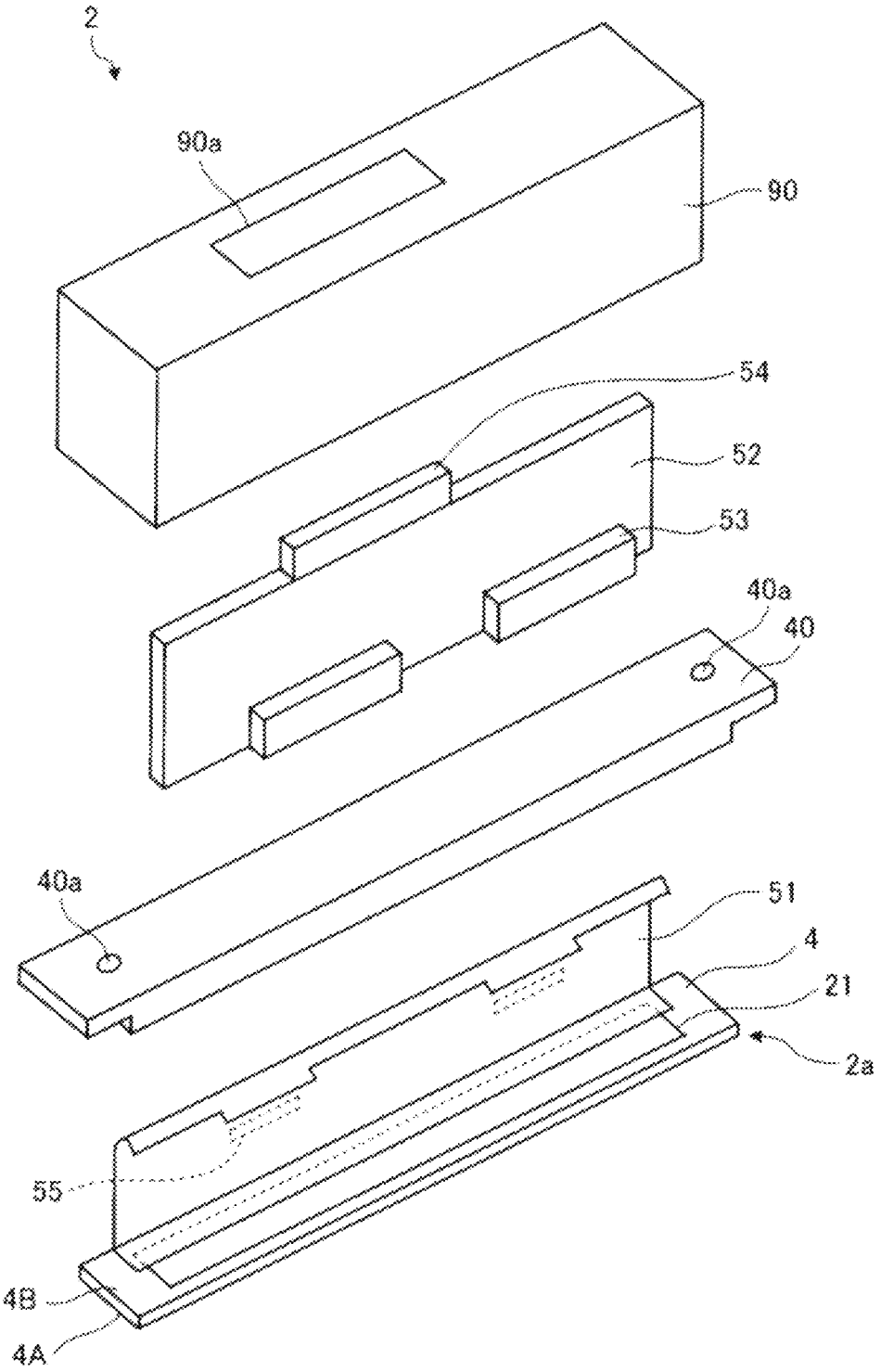
FIG. 2 is an exploded perspective view schematically illustrating a liquid discharge head according to an embodiment.
Figure 3:
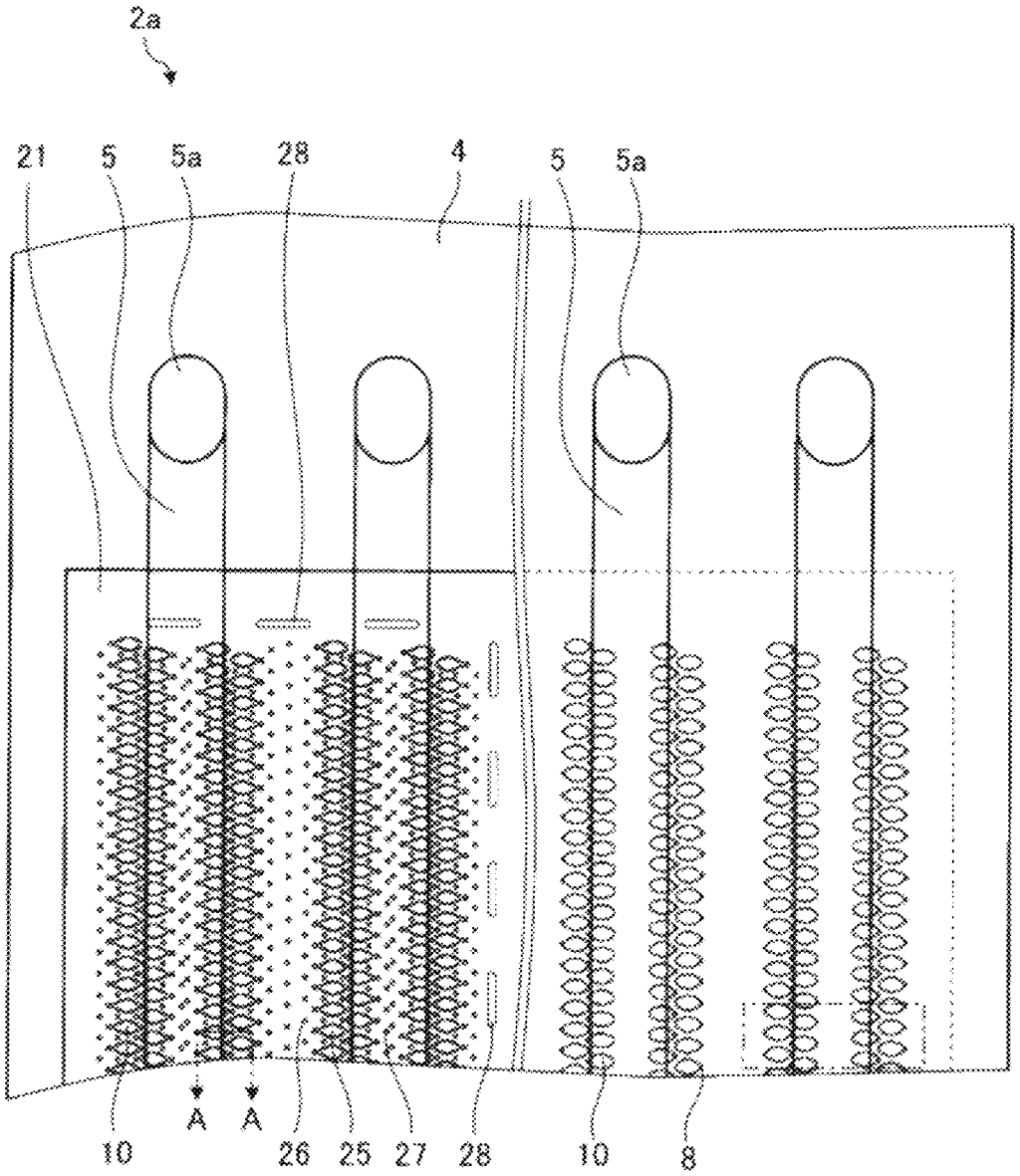
FIG. 3 is an enlarged plan view of the liquid discharge head illustrated in FIG. 2.
Figure 4:
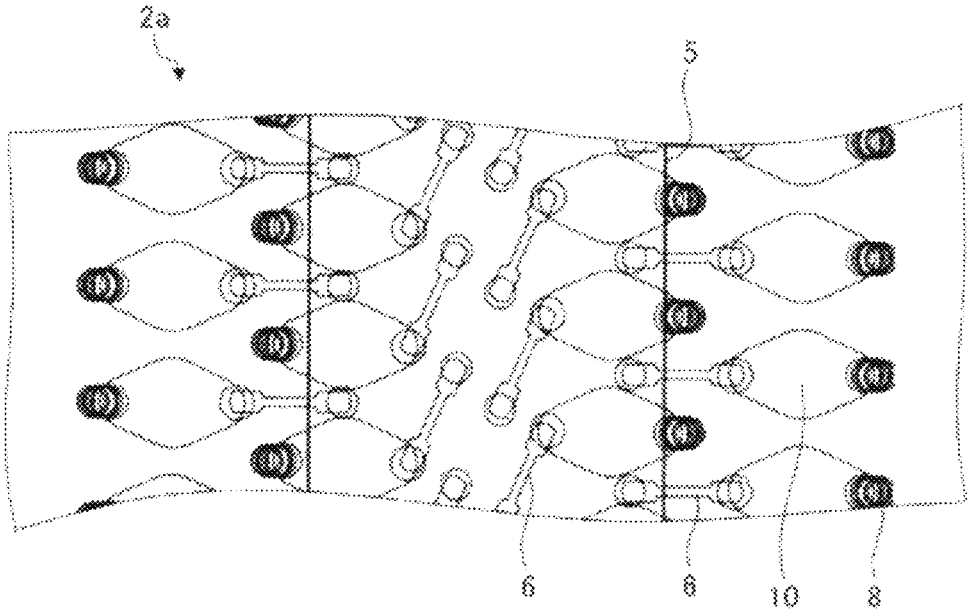
FIG. 4 is an enlarged view of a region surrounded by a dashed-dotted line illustrated in FIG. 3.
Figure 5:
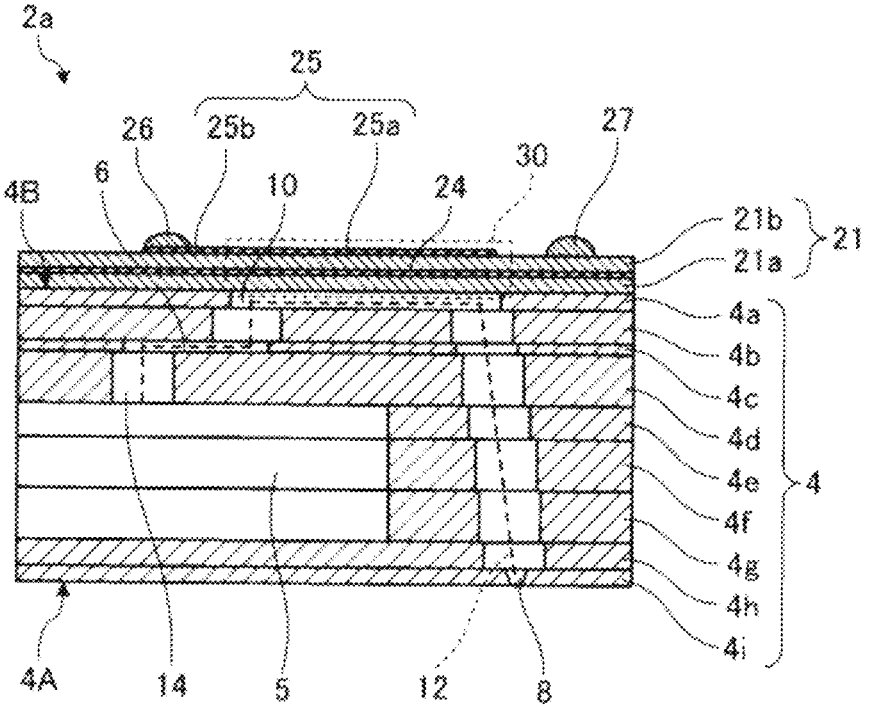
FIG. 5 is a cross-sectional view taken along a line A-A illustrated in FIG. 3.

Next, the liquid discharge head 2 according to an embodiment will be described with reference to FIGS. 2 to 5. FIG. 2 is an exploded perspective view schematically illustrating the liquid discharge head 2 according to an embodiment. FIG. 3 is an enlarged plan view of the liquid discharge head 2. FIG. 3 illustrates a part of the liquid discharge head 2 in an enlarged manner, and a piezoelectric actuator substrate 21 is omitted in the right half of the figure. FIG. 4 is an enlarged view of a region surrounded by a dashed-dotted line illustrated in FIG. 3. In FIG. 3 and FIG. 4, some channels are omitted for the purpose of explanation, and in order to facilitate the understanding of the drawings, manifolds 5 and the like to be illustrated by using a dashed line are illustrated by using a solid line. FIG. 5 is a cross-sectional view along a line A-A illustrated in FIG. 3.

As illustrated in FIG. 2, the liquid discharge head 2 includes a head body 2*a* including a flow channel member 4 and a piezoelectric actuator substrate 21, a reservoir 40, an electrical circuit substrate 52, and a head cover 90. The head body 2*a* has a first surface configured to discharge liquid and a second surface facing the first surface. In the following, the first surface will be described as the discharge hole surface 4A in the flow channel member 4 and the second surface will be described as a pressurizing chamber surface 4B.

The piezoelectric actuator substrate 21 is positioned on the pressurizing chamber surface 4B of the flow channel member 4. Two signal transmission units 51 are electrically connected to the piezoelectric actuator substrate 21. Each signal transmission unit 51 includes a plurality of drive integrated circuits (ICs) 55. Note that, in FIG. 2, one of the signal transmission units 51 is omitted.

The signal transmission unit 51 provides a signal to each of displacement elements 30 (see FIG. 5) of the piezoelectric actuator substrate 21. The signal transmission unit 51 can be formed by, for example, a flexible printed circuit (FPC) or the like.

Drive ICs 55 are mounted on the signal transmission unit 51. The drive IC 55 controls driving of each displacement element 30 (see FIG. 5) of the piezoelectric actuator substrate 21.

The reservoir 40 is positioned on the pressurizing chamber surface 4B other than the piezoelectric actuator substrate 21. The reservoir 40 includes a channel therein, and is supplied with liquid through an opening 40*a* from the outside. The reservoir 40 has a function of supplying liquid to the flow channel member 4 and a function of storing the liquid.

An electrical circuit substrate 52 is erected on the reservoir 40. A plurality of connectors 53 are positioned on both main surfaces of the electrical circuit substrate 52. An end portion of the signal transmission unit 51 is housed in each connector 53. Connectors 54 for power supply are positioned on an end surface on an opposite side to the reservoir 40 of the electrical circuit substrate 52. The electrical circuit substrate 52 distributes an electrical current supplied from the outside via the connectors 54 to the connectors 53, and supplies the electrical current to the signal transmission unit 51.

A head cover 90 has openings 90*a*. The head cover 90 is positioned on the reservoir 40, and covers the electrical circuit substrate 52. With this, the electrical circuit substrate 52 is sealed. The connectors 54 of the electrical circuit substrate 52 are inserted so as to be exposed to the outside from the openings 90*a*. The drive IC 55 is in contact with a side surface of the head cover 90. The drive IC 55 is pressed against the side surface of the head cover 90, for example. Due to this, heat generated by the drive IC 55 is dissipated (radiated) from a contact portion on the side surface of the head cover 90. A more specific configuration of the head cover 90 will be described later with reference to FIG. 6 and the subsequent figures.

Note that the liquid discharge head 2 may further include other members other than these members.

As illustrated in FIG. 3, FIG. 4, and FIG. 5, the head body 2*a* includes the flow channel member 4 and the piezoelectric actuator substrate 21.

The flow channel member 4 has a flat plate shape and includes a channel therein. The flow channel member 4 includes the manifolds 5, a plurality of discharge holes 8, and a plurality of pressurizing chambers 10. The plurality of pressurizing chambers 10 are connected to the manifolds 5. Each of the plurality of discharge holes 8 is connected to the corresponding one of the plurality of pressurizing chambers 10. The pressurizing chamber 10 is open in the upper surface of the flow channel member 4, and the upper surface of the flow channel member 4 is the pressurizing chamber surface 4B. Furthermore, openings 5*a* connected to the manifolds 5 are provided on the pressurizing chamber surface 4B of the flow channel member 4. Liquid is supplied through the openings 5*a* from the reservoir 40 (see FIG. 2) to the interior of the flow channel member 4.

In the example illustrated in FIG. 3, the head body 2*a* is provided with four manifolds 5 inside the flow channel member 4. The manifold 5 has a long thin shape extending along the longitudinal direction of the flow channel member 4, and at both ends thereof, the opening 5*a* of the manifold 5 is formed in the upper surface of the flow channel member 4. In the present embodiment, the four manifolds 5 are independently provided.

The flow channel member 4 is formed such that the plurality of pressurizing chambers 10 expand in two dimensions. The pressurizing chamber 10 is a hollow region having a substantially diamond-shaped planar shape with corner portions that are rounded. The pressurizing chambers 10 are open in the pressurizing chamber surface 4B that is the upper surface of the flow channel member 4, and are blocked by the piezoelectric actuator substrate 21 being connected.

The pressurizing chambers 10 constitute rows of pressurizing chambers that are arranged in the longitudinal direction. The pressurizing chambers 10 constituting each row of pressurizing chambers are arranged in a staggered manner so that the corner portions of the pressurizing chambers are positioned between two rows of pressurizing chambers in adjacent rows of pressurizing chambers. A pressurizing chamber group is configured by four rows of pressurizing chambers connected to one manifold 5, and the flow channel member 4 has four pressurizing chamber groups. The relative arrangement of the pressurizing chambers 10 within each pressurizing chamber group is the same, and each of the pressurizing chamber groups is arranged so as to be slightly shifted to each other in the longitudinal direction.

The pressurizing chamber 10 and the manifold 5 are connected through a separate supply channel 14. The separate supply channel 14 includes a squeeze 6 having a width narrower than those of the other portions. The squeeze 6 has a higher channel resistance due to the width narrower than those of the other portions of the separate supply channel 14. In this way, when the channel resistance of the squeeze 6 is high, the pressure generated in the pressurizing chamber 10 is less likely to be released to the manifold 5.

The discharge hole 8 is disposed at a position that avoids a region of the flow channel member 4 facing the manifold 5. In other words, the discharge hole 8 does not overlap with the manifold 5 when the flow channel member 4 is viewed as being transmitted from the pressurizing chamber surface 4B. Furthermore, in a plan view, the discharge holes 8 are disposed so as to fit within a mounting region of the piezoelectric actuator substrate 21. These discharge holes 8 occupy a region having approximately the same size and shape as those of the piezoelectric actuator substrate 21 as one group, and droplets are discharged from the discharge holes 8 by displacing the corresponding displacement elements 30 of the piezoelectric actuator substrate 21.

As illustrated in FIG. 5, the flow channel member 4 has a laminated structure in which a plurality of plates are laminated. These plates are a cavity plate 4*a*, a base plate 4*b*, an aperture (squeeze) plate 4*c*, a supply plate 4*d*, manifold plates 4*e* to 4*g*, a cover plate 4*h*, and a nozzle plate 4*i* in order from the upper surface of the flow channel member 4.

Many holes are formed in these plates. Due to a thickness of each plate being approximately 10 μm to 300 μm, the forming accuracy of the holes to be formed can be increased. The respective plates are laminated in alignment such that these holes communicate with each other to form the separate channels 12 and the manifolds 5. The head body 2*a* has a configuration in which the pressurizing chambers 10 are disposed on the upper surface of the flow channel member 4, the manifolds 5 are provided at a lower surface side of the interior of the flow channel member 4, the discharge holes 8 are disposed on a lower surface of the flow channel member 4, respective portions constituting the separate channels 12 are disposed close to each other at different positions, and the manifolds 5 and the discharge holes 8 are connected through the pressurizing chambers 10.

As illustrated in FIG. 3 and FIG. 5, the piezoelectric actuator substrate 21 includes piezoelectric ceramic layers 21*a* and 21*b*, a common electrode 24, separate electrodes 25, connecting electrodes 26, dummy connecting electrodes 27, and surface electrodes 28. The piezoelectric actuator substrate 21 is laminated with the piezoelectric ceramic layers 21*a*, the common electrode 24, the piezoelectric ceramic layers 21*b*, and the separate electrodes 25 in this order.

Each of the piezoelectric ceramic layers 21*a* and 21*b* has a thickness of approximately 20 μm. Any layer of the piezoelectric ceramic layers 21*a* and 21*b* extends across the plurality of pressurizing chambers 10. A lead zirconate titanate (PZT)-based ceramic material having ferroelectricity may be used for these piezoelectric ceramic layers 21*a* and 21*b*.

The common electrode 24 is formed over substantially the entire surface in a surface direction in a region between the piezoelectric ceramic layer 21*a* and the piezoelectric ceramic layer 21*b*. That is, the common electrode 24 overlaps with all of the pressurizing chambers 10 in a region facing the piezoelectric actuator substrate 21. A thickness of the common electrode 24 is approximately 2 μm. For example, a metal material such as an Ag—Pd-based material may be used for the common electrode 24.

The separate electrode 25 includes a separate electrode body 25*a* and an extraction electrode 25*b*. The separate electrode body 25*a* is positioned in a region facing the pressurizing chamber 10 on the piezoelectric ceramic layer 21*b*. The separate electrode body 25*a* is slightly smaller than the pressurizing chamber 10, and has a shape substantially similar to that of the pressurizing chamber 10. The extraction electrode 25*b* is extracted from the separate electrode body 25*a*. The connecting electrode 26 is formed in a portion extracted out of the region facing the pressurizing chamber 10 at one end of the extraction electrode 25*b*. For example, a metal material such as an Au-based material may be used for the separate electrode 25.

The connecting electrode 26 is positioned on the extraction electrode 25*b*, has a thickness of approximately 15 μm, and is formed in a protruding shape. In addition, the connecting electrode 26 is electrically connected to an electrode provided in the signal transmission unit 51 (see FIG. 2). For example, silver-palladium containing glass frit may be used for the connecting electrode 26.

The dummy connecting electrode 27 is positioned on the piezoelectric ceramic layer 21*b* and is positioned so as not to overlap with various electrodes such as the separate electrodes 25. The dummy connecting electrode 27 connects the piezoelectric actuator substrate 21 and the signal transmission unit 51, and increases connection strength. Also, the dummy connecting electrode 27 equalizes the distribution of the contact positions of the piezoelectric actuator substrate 21 and the piezoelectric actuator substrate 21, and stabilizes electrical connection. The dummy connecting electrode 27 may be formed of an equivalent material and by an equivalent process as the connecting electrode 26.

The surface electrode 28 is formed at a position where the separate electrodes 25 are avoided on the piezoelectric ceramic layer 21*b*. The surface electrode 28 is connected to the common electrode 24 through a via hole formed in the piezoelectric ceramic layer 21*b*. As a result, the surface electrode 28 is grounded and held at a ground potential. The surface electrode 28 may be formed of an equivalent material and by an equivalent process as the separate electrode 25.

The plurality of separate electrodes 25 are individually electrically connected to the control unit 88 (see FIG. 1A) via the signal transmission unit 51 and wirings in order to individually control the electrical potentials. Regarding the piezoelectric ceramic layer 21*b* sandwiched between the separate electrode 25 and the common electrode 24, when the separate electrode 25 and the common electrode 24 are set to different potentials and an electric field is applied to the piezoelectric ceramic layer 21*b* in a polarization direction thereof, the portion where the electric field is applied serves as an active section that is distorted due to the piezoelectric effect. As a result, the separate electrode 25, the piezoelectric ceramic layer 21*b*, and the common electrode 24 that face the pressurizing chamber 10 function as the displacement element 30. Then, due to unimorph deformation of the displacement element 30, the pressurizing chamber 10 is pressed and liquid is discharged from the discharge hole 8.

Here, a driving procedure in the present embodiment will be described. The separate electrodes 25 are set in advance to a higher potential (hereinafter referred to as a high potential) than that of the common electrode 24. Each time there is a demand for discharge, the separate electrodes 25 are set to the same potential as that of the common electrode 24 (hereinafter referred to as a low potential) once, and then are set to the high potential again at a predetermined timing. As a result, when the separate electrodes 25 are set to the low potential, the piezoelectric ceramic layers 21*a* and 21*b* return to their original shape, and a volume of the pressurizing chamber 10 is increased compared with an initial state (a state in which the potentials of the two electrodes are different).

At this time, negative pressure is applied to the pressurizing chamber 10, and liquid is sucked from the manifold 5 side into the interior of the pressurizing chamber 10. Then, when the separate electrodes 25 are set to the high potential again, the piezoelectric ceramic layers 21*a* and 21*b* are deformed so as to have a protruding shape toward the pressurizing chamber 10 side, and pressure inside the pressurizing chamber 10 becomes positive pressure due to a decrease in the volume of the pressurizing chamber 10. As a result, the pressure on the liquid inside the pressurizing chamber 10 rises, and droplets are discharged. That is, in order to discharge the droplets, a driving signal including a pulse with the high potential being as a reference will be supplied to the separate electrodes 25. The pulse width may be set to an acoustic length (AL) that is a length of time when a pressure wave propagates from the squeeze 6 to the discharge hole 8. Due to this, when the interior of the pressurizing chamber 10 is inverted from the negative pressure state to the positive pressure state, pressure in both states is combined, and droplets can be discharged at a higher pressure.

Additionally, in gradation printing, gradation expression is performed by the number of droplets to be continuously discharged from the discharge hole 8, that is, an amount (volume) of droplets to be adjusted by the number of droplets to be discharged. Thus, the number of droplets to be discharged corresponding to the specified gradation expression is continuously performed from the discharge hole 8 corresponding to the specified dot region. In general, when the liquid discharge is continuously performed, an interval between the pulses that are supplied to discharge the droplets may be set to the AL. Due to this, a period of a residual pressure wave of pressure generated in discharging the droplets discharged earlier matches a period of a pressure wave of pressure to be generated in discharging droplets to be discharged later. As a result, the pressure for discharging the droplets can be amplified by superimposing the residual pressure wave and the pressure wave. Note that in this case, the speed of the droplets to be discharged later is increased, and impact points of the plurality of droplets become close.

<Head Cover 90>

Figure 6:
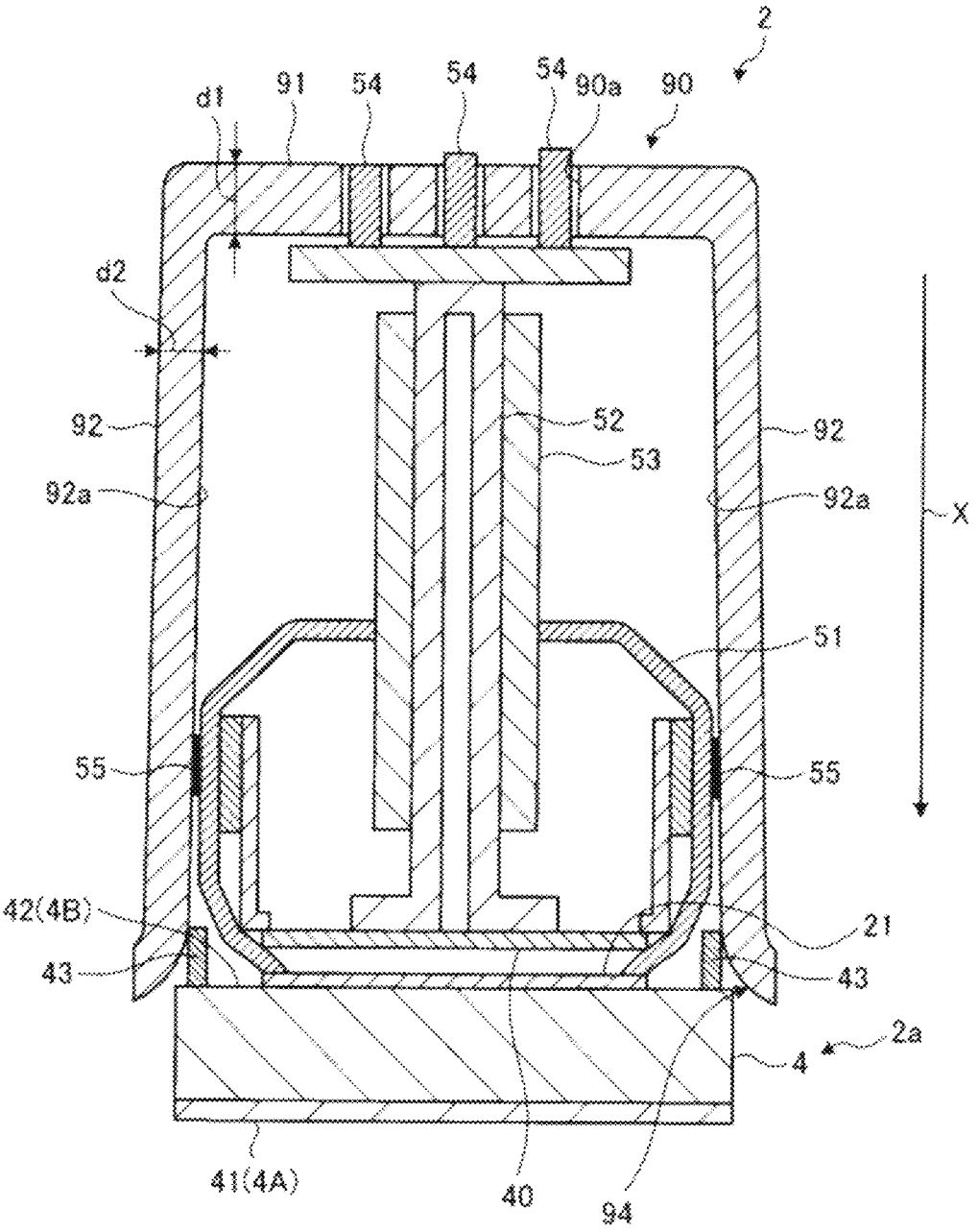
FIG. 6 is a schematic cross-sectional view of the liquid discharge head according to an embodiment.
Figure 7A:
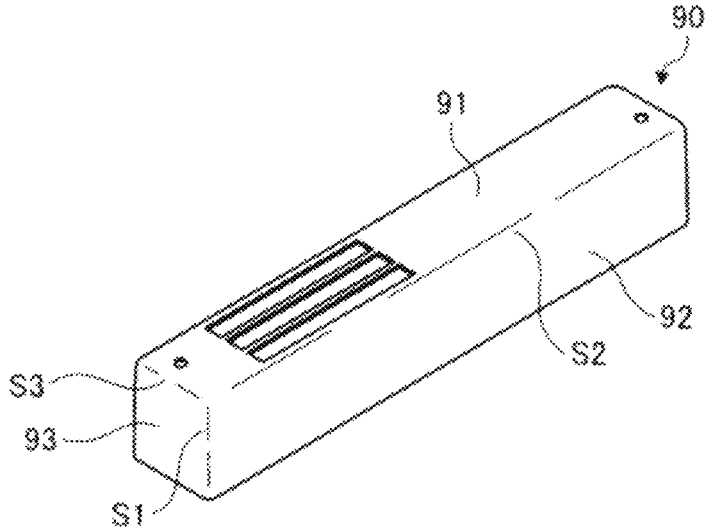
FIG. 7A is a perspective view of a head cover.
Figure 7B:
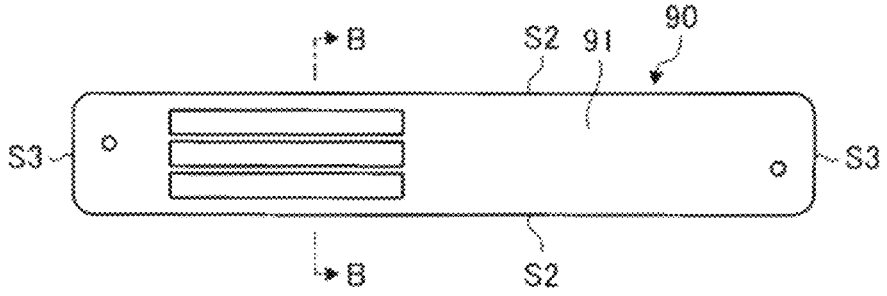
FIG. 7B is a plan view of the head cover.
Figure 7C:
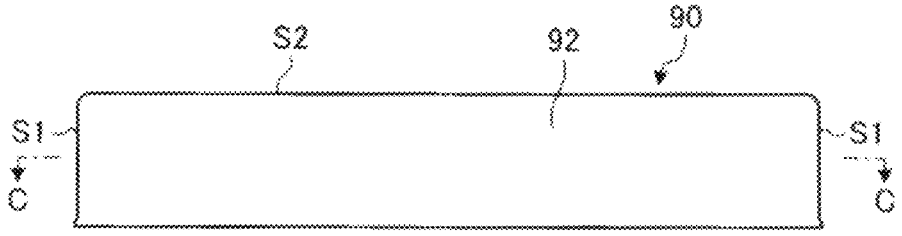
FIG. 7C is a side view of the head cover.
Figure 8A:
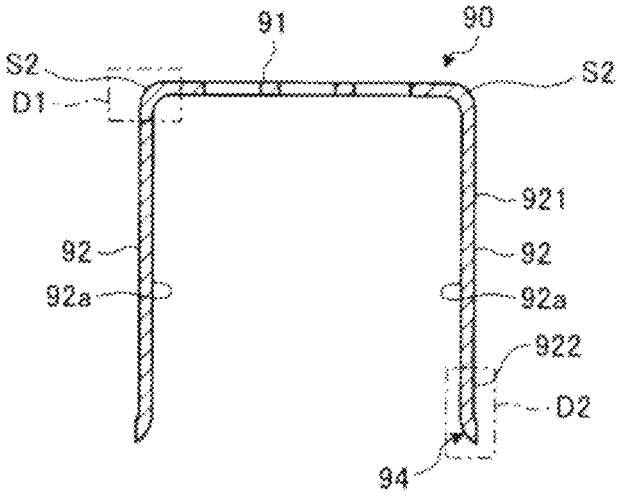
FIG. 8A is a cross-sectional view taken along a line B-B illustrated in FIG. 7B.
Figure 8B:
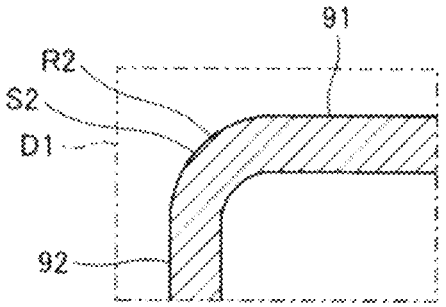
FIG. 8B is an enlarged view of a portion D1 illustrated in FIG. 8A.
Figure 8C:
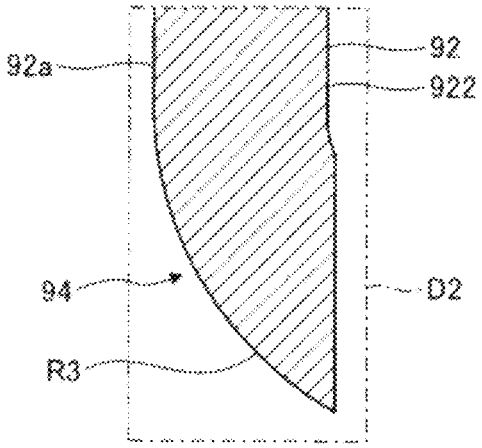
FIG. 8C is an enlarged view of a portion D2 illustrated in FIG. 8A.
Figure 9A:
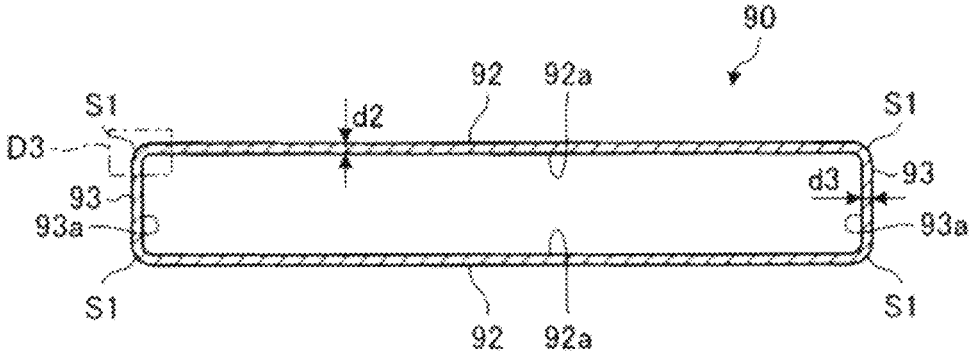
FIG. 9A is a cross-sectional view taken along a line C-C illustrated in FIG. 7C.
Figure 9B:
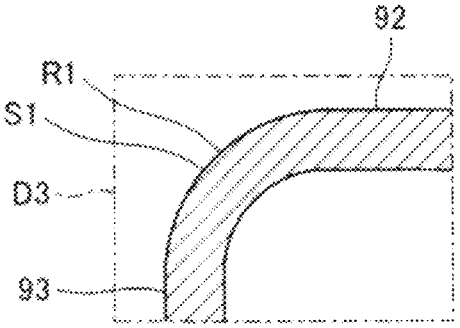
FIG. 9B is an enlarged view of a portion D3 illustrated in FIG. 9A.

Next, the head cover 90 will be described with reference to FIGS. 6 to 9B. FIG. 6 is a schematic cross-sectional view of the liquid discharge head 2 according to an embodiment. Note that an X direction illustrated in FIG. 6 is a direction from a top plate 91 toward a second surface 42 of the head body 2*a*. FIG. 7A is a perspective view of the head cover 90. FIG. 7B is a plan view of the head cover 90. FIG. 7C is a side view of the head cover 90. FIG. 8A is a cross-sectional view taken along a line B-B illustrated in FIG. 7B. FIG. 8B is an enlarged view of a portion D1 illustrated in FIG. 8A. FIG. 8C is an enlarged view of a portion D2 illustrated in FIG. 8A. FIG. 9A is a cross-sectional view taken along a line C-C illustrated in FIG. 7C. FIG. 9B is an enlarged view of a portion D3 illustrated in FIG. 9A.

As described above, the liquid discharge head 2 includes the flow channel member 4, the piezoelectric actuator substrate 21, the reservoir 40, the electrical circuit substrate 52, and the head cover 90. The flow channel member 4 and the piezoelectric actuator substrate 21 constitute the head body 2*a*. The flow channel member 4 includes the discharge hole surface 4A and the pressurizing chamber surface 4B. In addition, the flow channel member 4 includes a side cover 43 on the pressurizing chamber surface 4B. The side cover 43 protrudes from the pressurizing chamber surface 4B toward the top plate 91 side in a state where the head cover 90 is mounted.

The piezoelectric actuator substrate 21 is electrically connected to the signal transmission unit 51. The signal transmission unit 51 includes the plurality of drive ICs 55 that drive the head body 2*a*. The signal transmission unit 51 is drawn upward from the piezoelectric actuator substrate 21 through the side of the reservoir 40. Note that the plurality of drive ICs 55 may be included. The plurality of drive ICs 55 are arranged side by side, for example, in a direction orthogonal to the X direction (in the longitudinal direction of the liquid discharge head 2).

As described above, the electrical circuit substrate 52 is provided with a connector 54 for power supply. The connector 54 protrudes in a direction opposite to the X direction from the electrical circuit substrate 52. Note that a plurality of connectors 54 may be provided. In this case, a plurality of openings 90*a* of the head cover 90 in the top plate 91 are provided according to the plurality of connectors 54.

As illustrated in FIG. 6, the head body 2*a* includes a first surface 41 that discharges liquid and a second surface 42 that faces the first surface 41. Note that the first surface 41 of the head body 2*a* is the discharge hole surface 4A in the flow channel member 4, and the second surface 42 is the pressurizing chamber surface 4B in the flow channel member 4.

As illustrated in FIG. 7A, FIG. 7B, and FIG. 7C, the head cover 90 has a bottomed cylindrical shape. In other words, the head cover 90 has a box shape having openings. The head cover 90 can be made of metal such as aluminum, or resin or the like, for example. As illustrated in FIG. 6, the head cover 90 is positioned on the head body 2*a* so as to cover at least the second surface 42 of the head body 2*a* while housing the signal transmission unit 51 including the drive ICs 55, the reservoir 40, and the electrical circuit substrate 52. The head cover 90 extends in the X direction.

The head cover 90 includes the top plate 91, a first side plate 92, and a second side plate 93. The top plate 91 has a rectangular shape having long sides and short sides, and faces the second surface 42 of the head body 2*a*. The top plate 91 is long in the longitudinal direction of the liquid discharge head 2. The first side plate 92 has a rectangular shape, and is connected to the long side of the top plate 91. A pair of the first side plates 92 are provided, for example, and face each other with the top plate 91 sandwiched. The first side plate 92 is long in the longitudinal direction of the liquid discharge head 2.

As illustrated in FIG. 8A, the first side plate 92 includes a first portion 921 and a second portion 922. The first portion 921 is a portion that extends in the X direction. The second portion 922 is a portion positioned closer to the second surface 42 than the first portion 921. Of an inner surface 92*a* of the first side plate 92, an inner surface of the first portion 921 (that is, an inner surface 92*a* of the first side plate 92) is in contact with the drive IC 55 in a state where the head cover 90 is mounted. Of the inner surface 92*a* of the first side plate 92, an inner surface of the second portion 922 (that is, the inner surface 92*a* of the first side plate 92) includes a diameter expanding portion 94, which will be described below, having a diameter expanding toward the second surface 42.

The second side plate 93 has a rectangular shape, is connected to the short sides of the top plate 91, and is connected to the first side plate 92. Furthermore, a pair of the second side plates 93 are provided, for example, and face each other with the top plate 91 sandwiched. Note that the drive IC 55 is not in contact with an inner surface 93*a* of the second side plate 93 in a state where the head cover 90 is mounted. In addition, respective areas of the top plate 91, the first side plate 92, and the second side plate 93 are larger in the order of the first side plate 92, the top plate 91, and the second side plate 93.

As illustrated in FIG. 6, a thickness d2 of the first side plate 92 is thinner than a thickness d1 of the top plate 91. Also, although not illustrated, the thickness d2 of the first side plate 92 is thicker than a thickness d3 of the second side plate 93. Also, although not illustrated, the thickness d3 of the second side plate 93 is thinner than the thickness d1 of the top plate 91. In other words, regarding the magnitude relationship among the thickness d1 of the top plate 91, the thickness d2 of the first side plate 92, and the thickness d3 of the second side plate 93, d1>d2>d3 is satisfied, the first side plate 92 having the largest area is the thickest, the top plate 91 is the second thickest, and the second side plate 93 having the smallest area is the thinnest.

Here, each of the thicknesses d1, d2, and d3 of the top plate 91, the first side plate 92, and the second side plate 93 is an average value of each of the plates 91, 92, and 93. In other words, for each of the top plate 91, the first side plate 92, and the second side plate 93, for example, thicknesses at three points are measured, and the average value thereof is defined as each thickness. As the thicknesses d1, d2, and d3 of the respective plates 91, 92, and 93, when the liquid discharge head 2 is an inkjet head, for example, the thickness d1 of the top plate 91 is approximately 1.00 mm, the thickness d2 of the first side plate 92 is approximately 0.90 mm, and the thickness d3 of the second side plate 93 is approximately 0.75 mm. Note that the head cover 90 can be manufactured by, for example, punching the plates 91, 92, and 93 described above into sizes of the top plate 91, the first side plate 92, and the second side plate 93, respectively and welding each of the punched plates. Additionally, the head cover 90 can be manufactured by pressing a single plate.

As illustrated in FIG. 7A, FIG. 7B, and FIG. 7C, the head cover 90 has a first side S1, a second side S2, and a third side S3. The first side S1 is a portion connecting the first side plate 92 and the second side plate 93. The first side S1 extends in the X direction illustrated in FIG. 6. The second side S2 is a portion connecting the top plate 91 and the first side plate 92. The second side S2 extends in the longitudinal direction of the head cover 90. The third side S3 is a portion connecting the top plate 91 and the second side plate 93. The third side S3 extends in a direction orthogonal to the longitudinal direction of the head cover 90 (in a lateral direction of the head cover 90). A length of the second side S2 is longer than a length of the first side S1, and is longer than a length of the third side S3. Also, the length of the first side S1 is longer than the length of the third side S3.

As illustrated in FIG. 7A, FIG. 8A, and FIG. 8B, the first side S1 has a first radius R1 such that the outer surface is a curved surface. Note that the third side S3 may also have the first radius R1. Additionally, as illustrated in FIG. 9A and FIG. 9B, the second side S2 has a second radius R2 such that the outer surface is a curved surface. Here, regarding curvatures of the two radii R1 and R2, that of the first radius R1 is larger than that of the second radius R2. Note that the curvatures of the radii R1 and R2 are measured by using a known laser curvature measuring device.

As illustrated in FIGS. 8A and 8C, the diameter expanding portion 94 is positioned at an end portion, of the inner surface 92*a* of the second portion 922 of the first side plate 92, on the pressurizing chamber surface 4B side. When viewed from the top surface of the head cover 90, in other words, when viewed from the top plate 91 side, the diameter expanding portion 94 is a portion where a diameter of the inner surface 92*a* is widened. In other words, the head cover 90 has a shape in which an opening expands when viewed from the top plate 91 side.

The diameter expanding portion 94 has a pointed tip and a tip edge portion. The inner surface 92*a* of the tip edge portion has a radius (third radius) R3. This third radius R3 forms the diameter expanding portion 94 of the second portion 922. In other words, the third radius R3 that curves outward is provided on the inner surface 92*a* of the tip edge portion, and thus, the diameter expanding portion 94 is formed in which the diameter of the head cover 90 expands. In other words, the cross-section shape of the diameter expanding portion 94 is a rounded shape.

With the first side plate 92 having the third radius R3 on the inner surface 92*a* of the second portion 922, a tip opening of the head cover 90 expands outward. Note that the third radius R3 may also be provided at the tip edge portion serving as the second surface 42 side in the inner surface 93*a* of the second side plate 93.

The diameter expanding portion 94 includes a protruding portion 95 that protrudes outward (see FIG. 11A), on the outer surface. That is, the diameter expanding portion 94 may include the protruding portion 95, which protrudes outward, on the outer surface. Furthermore, the protruding portion 95 extends in the X direction (see FIG. 6). The protruding portion 95 is a portion, which is illustrated in FIG. 8C, positioned on the right side of the page relative to an imaginary line extending from the first portion 921*a* in the X direction. In the protruding portion 95, a length in the X direction is longer than a length (thickness) in the thickness direction of the first side plate 92. Furthermore, the protruding portion 95 extends in the X direction. According to such a configuration, when the atomized liquid (for example, ink mist) travels through the protruding portion 95, the liquid can be guided along one direction to a tip edge of the first side plate 92. As a result, the intrusion of liquid into the interior of the head cover 90 can be suppressed.

Figure 10A:
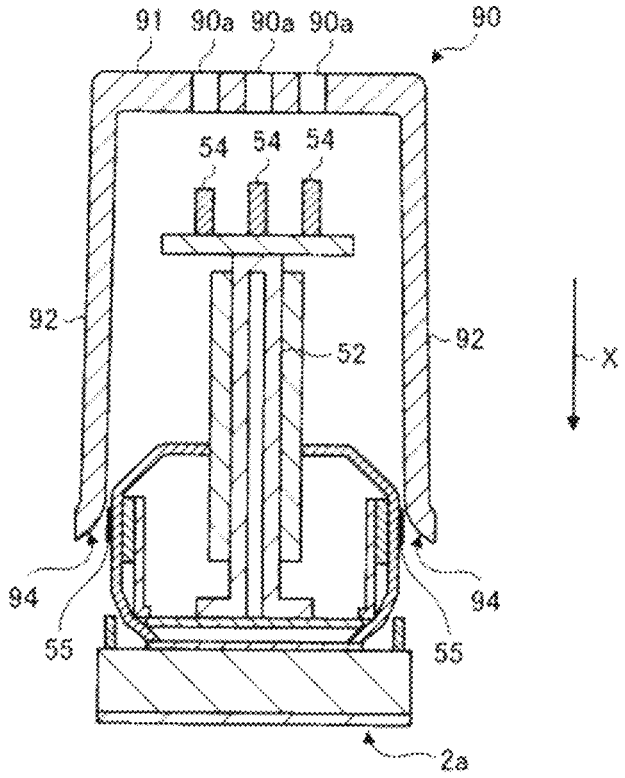
FIG. 10A is an explanatory diagram (1) of an attachment operation of the head cover.
Figure 10B:
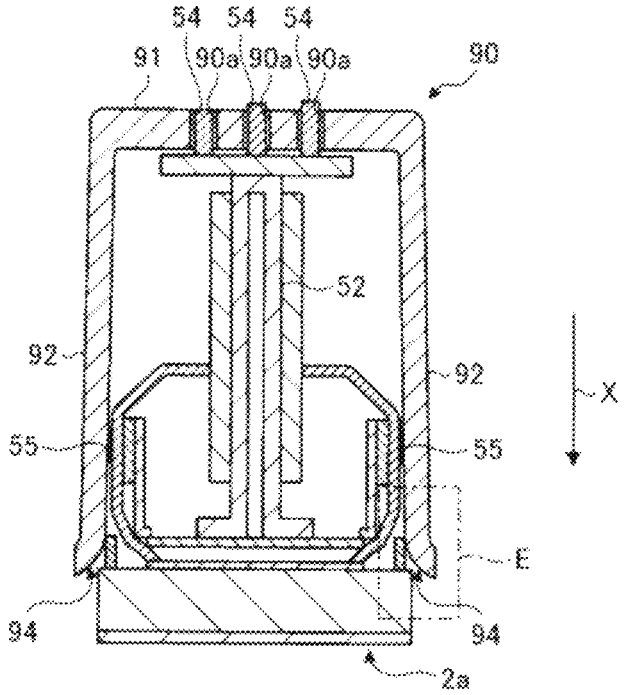
FIG. 10B is an explanatory diagram (2) of the attachment operation of the head cover.

Next, an attachment operation of the head cover 90 will be described with reference to FIG. 10A and FIG. 10B. FIG. 10A and FIG. 10B are explanatory diagrams of the attachment operation of the head cover 90, FIG. 10A illustrates a state before the attachment of the head cover 90, and FIG. 10B illustrates a state after the attachment of the head cover 90.

As illustrated in FIG. 10A, the head cover 90 is mounted to the head body 2*a* from the X direction. At this time, since the tip edge portion of the first side plate 92 is not in contact with the drive IC 55 housed in the head cover 90 by the diameter expanding portion 94, the drive IC 55 is less likely to be damaged. Alternatively, since the head cover 90 includes the diameter expanding portion 94, even when the diameter expanding portion 94 and the drive IC 55 are in contact with each other, the diameter expanding portion 94 can smoothly guide the drive IC 55 to the interior of the head cover 90, and the drive IC 55 is less likely to be damaged.

As illustrated in FIG. 10B, in a state where the head cover 90 is mounted, the connectors 54 are inserted through the plurality of openings 90*a* of the top plate 91, thereby are positioned, and as a result, the head cover 90 is fixed to the head body 2*a*.

According to such a configuration, since the head cover 90 is fixed by inserting the connectors 54 through the openings 90*a* of the top plate 91 having a thick thickness, it is possible to firmly fix the head cover 90 and the electrical circuit substrate 52. That is, the head cover 90 can be firmly fixed to the head body 2*a*.

Figure 11A:
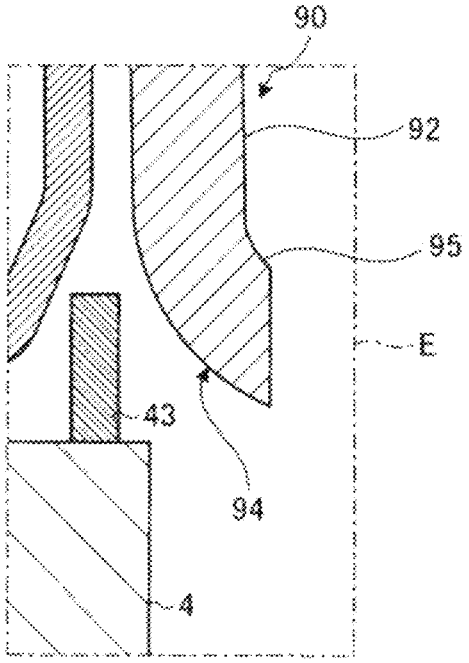
FIG. 11A is an enlarged view (1) of a portion E illustrated in FIG. 10B.
Figure 11B:
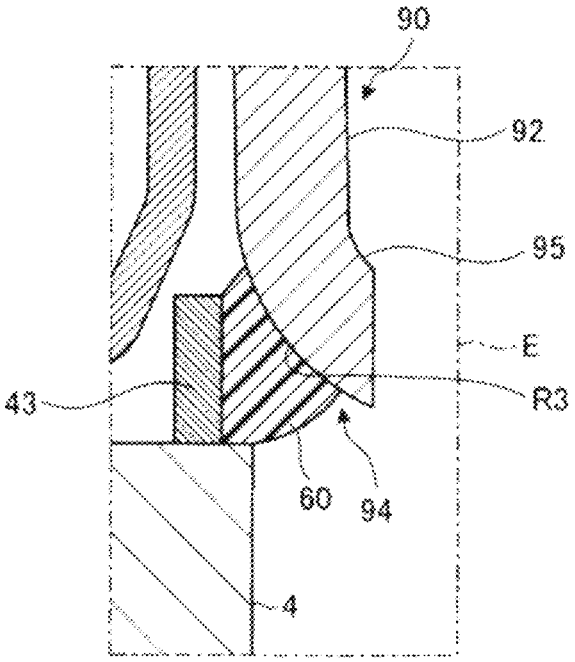
FIG. 11B is an enlarged view (2) of the portion E illustrated in FIG. 10B.

Next, the tip edge portion (diameter expanding portion 94) in an attached state of the head cover 90 will be described with reference to FIG. 11A and FIG. 11B. FIG. 11A and FIG. 11B are enlarged views of a portion E illustrated in FIG. 10B, and FIG. 11A illustrates a state before a sealing member 60 is disposed, and FIG. 11B illustrates a state after the sealing member 60 is disposed.

As illustrated in FIG. 11A, the head cover 90 is disposed separated from the flow channel member 4 in a state of being mounted to the head body 2*a*. That is, the head cover 90 has a gap with the flow channel member 4, and is not in contact with the flow channel member 4. Since the tip edge portion of at least the first side plate 92, of the tip edge portion of the first side plate 92 serving as the tip edge portion of the head cover 90, is not in contact with the flow channel member 4, heat is less likely to be transferred from the first side plate 92 to the flow channel member 4. As a result, transfer of heat generated by the drive IC 55 to the flow channel member 4 can be suppressed. As a result, the temperature of the liquid flowing through the flow channel member 4 is less likely to increase, and the discharge characteristics are less likely to decrease.

Further, the head cover 90 may cover the side cover 43 in the state of being mounted to the head body 2*a*. According to such a configuration, it is difficult for atomized liquid (for example, ink mist) to intrude from a gap between the head cover 90 and the side cover 43. As a result, it is possible to suppress the intrusion of liquid into the interior of the liquid discharge head 2. This can improve sealing properties of the liquid discharge head 2.

As illustrated in FIG. 11B, the sealing member 60 is, for example, sealing resin, and is positioned between the head cover 90 and the side cover 43 so as to seal the gap between the head cover 90 and the flow channel member 4. With such a configuration, by configuring a dual sealing structure of the side cover 43 and the sealing member 60, the sealing properties can be further improved. In addition, since the diameter expanding portion 94 has the third radius R3, and thus, a surface area thereof increases, a contact area with the sealing member 60 increases, which can improve the sealing properties of the liquid discharge head 2. The sealing member 60 is formed of epoxy-based, silicon-based, or urethane-based thermosetting resin.

According to the above-described embodiment, since the thickness d2 of the first side plate 92 is thinner than the thickness d1 of the top plate 91, the heat generated by the drive IC 55 can be released more by the thin first side plate 92, and the strength of the head cover 90 can be maintained by the thick top plate 91. In other words, by reducing the thickness of the first side plate 92 being in contact with the drive IC 55, it is possible to maintain the strength of the head cover 90 by increasing the thickness of the top plate 91, where external force easily occurs, while improving the heat radiating properties of heat generated by the drive IC 55. As a result, it is possible to suppress a decrease in strength of the head cover 90 while improving the heat radiating properties.

Additionally, the thickness d3 of the second side plate 93 may be thinner than the thickness d2 of the first side plate 92. According to such a configuration, more heat can be released from the first side plate 92 to the thin second side plate 93.

Additionally, the area of the first side plate 92 may be larger than the area of the second side plate 93. Also in such a configuration, since heat transmitted to the first side plate 92 can be radiated to the second side plate 93, and the second side plate 93 is less likely to be in contact with other members, even when the second side plate 93 is thin, the second side plate 93 is less likely to be damaged. That is, it is possible to suppress a decrease in strength of the head cover 90 while improving the heat radiating properties of the liquid discharge head 2.

Additionally, the thickness d2 of the first side plate 92 may be larger than the thickness d3 of the second side plate 93. With such a configuration, since the strength of the first side plate 92 in contact with the drive IC 55 can be ensured and the first side plate 92 is less likely to be damaged, it is possible to suppress a decrease in sealing properties of the liquid discharge head 2.

Additionally, the first side S1 may have the first radius R1. With such a configuration, stress generated in the first side S1 of the head cover 90 due to the elongation of the first side plate 92 can be relaxed. As a result, the strength of the head cover 90 is increased, the head cover 90 is less likely to be broken, and it is possible to suppress the decrease in sealing properties of the liquid discharge head 2.

Furthermore, the second side S2 may have the second radius R2. With such a configuration, stress generated in the second side S2 of the head cover 90 due to the elongation of the first side plate 92 can be relaxed. As a result, the strength of the head cover 90 is increased, the head cover 90 is less likely to be broken, and it is possible to suppress the decrease in sealing properties of the liquid discharge head 2.

Additionally, the size of the first radius R1 may be larger than the size of the second radius R2. With such a configuration, stress generated in the first side S1 to which larger stress is applied among stress generated in each of the sides S1, S2, and S3 of the head cover 90 due to the elongation of the first side plate 92 can be more relaxed. That is, even when the first side plate 92 largely extends in the longitudinal direction thereof, the stress can be relaxed by the large first radius R1. As a result, the strength of the head cover 90 is increased, the head cover 90 is less likely to be broken, and it is possible to suppress the decrease in sealing properties of the liquid discharge head 2.

In addition, the inner surface 92*a* of the tip edge portion of at least the first side plate 92 among the tip edge portions of the side plates that serve as the tip edge portion of the head cover 90 may have a rounded shape. With such a configuration, the contact area of the sealing member (sealing resin) 60 is increased, the sealing member 60, such as sealing resin, is easily applied, and the applied sealing member 60 is firmly held. As a result, the sealing properties of the liquid discharge head 2 and the sealing workability of applying the sealing member 60 can be improved.

Then, with the printer 1 according to the above-described embodiment, in the liquid discharge head 2, it is possible to suppress a decrease in strength of the head cover 90 while improving the heat radiating properties.

Figure 12:
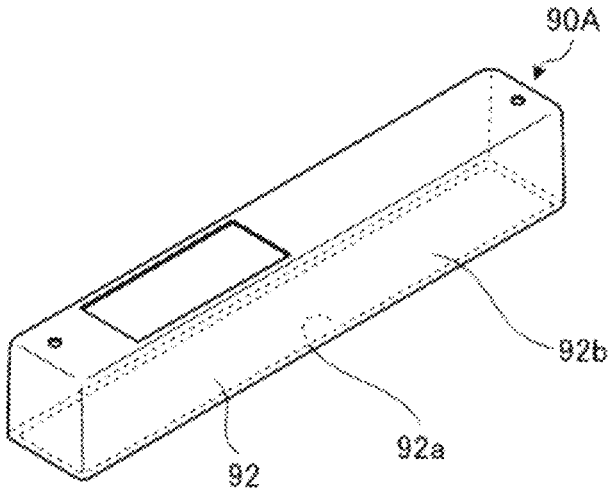
FIG. 12 is an explanatory diagram of a modified example (1) of the head cover.
Figure 13:
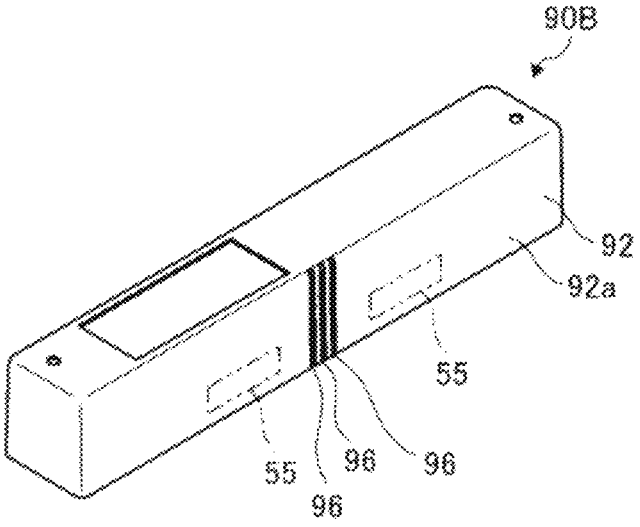
FIG. 13 is an explanatory diagram of a modified example (2) of the head cover.
Figure 14:
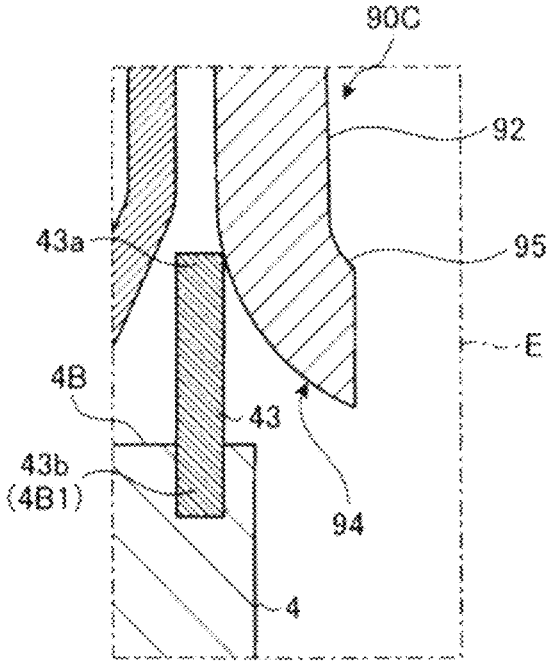
FIG. 14 is an explanatory diagram of a modified example (3) of the head cover.

Next, a modified example of the head cover will be described with reference to FIGS. 12 to 14. FIGS. 12 to 14 are explanatory diagrams of modified examples (head covers 90A, 90B, and 90C) of the head cover 90 described above, respectively. As illustrated in FIG. 12, in the head cover 90A according to the modified example, a surface roughness of the outer surface 92*b* in the first side plate 92 is rougher than a surface roughness of the inner surface 92*a*. For example, the roughness of the outer surface 92*b* is in a range from 10.00 μm to 28.00 μm. Additionally, the roughness of the inner surface 92*a* is in a range from 5.50 μm to 20.00 μm. Additionally, the surface roughness of the inner surface 92*a* in the first side plate 92 is rougher than the surface roughness of the top plate 91.

According to such a configuration, since the surface roughness of the outer surface 92*b* in the first side plate 92 is rougher than the surface roughness of the inner surface 92*a* that is in contact with the drive IC 55, contact properties between the inner surface 92*a* and the drive IC 55 can be ensured, and at the same time, since the surface area of the outer surface increases, heat radiating properties by the first side plate 92 can be improved.

Note that the surface roughness refers to a surface roughness measured in accordance with "JIS B 0601 (2013)", for example. A contact type surface roughness gauge or a non-contact type surface roughness gauge may be used for the measurement. As measurement conditions, for example, a measurement length is set to 0.4 mm, a cutoff value is set to 0.08 mm, a spot diameter is 0.4 μm, and a scanning speed is set to 1 mm/sec. Note that the measurement conditions may be set as appropriate.

As illustrated in FIG. 13, the head cover 90B according to the modified example includes a groove (recessed portion) 96 so as to be positioned between the plurality of drive ICs 55 in at least any one of the surfaces 92*a* and 92*b* of the inner surface 92*a* and the outer surface 92*b* in the first side plate 92. The groove 96 is along the X direction. Note that a plurality of grooves 96 may be provided.

According to such a configuration, when the plurality of drive ICs 55 are provided, heat is not easily transferred between the adjacent drive ICs 55. This makes the drive IC 55 less likely to malfunction.

FIG. 14 is a drawing corresponding to FIG. 11B of an embodiment. As illustrated in FIG. 14, the head cover 90C according to the modified example is disposed so as to be in contact with the side cover 43. For example, in the example of FIG. 14, the diameter expanding portion 94 of the head cover 90C is in contact with a tip portion 43*a* of the side cover 43.

Additionally, in the example illustrated in FIG. 14, the side cover 43 is configured of an electrically conductive material (for example, metal). Furthermore, a base end portion 43*b* of the side cover 43 fits a recessed portion 4B1 formed in the pressurizing chamber surface 4B of the flow channel member 4.

With such a configuration, it is possible to electrically connect between the flow channel member 4 and the head cover 90C via the side cover 43. As a result, when the flow channel member 4 is charged by static electricity generated during printing, such static electricity can be smoothly released to a GND terminal of the electrical circuit substrate 52 (see FIG. 6) via the side cover 43 and the head cover 90C.

Thus, according to the example of FIG. 14, it is possible to suppress a reduction in printing quality of the recording device 1 due to the static electricity generated during printing.

Additionally, in the example of FIG. 14, the electrical connection between the flow channel member 4 and the side cover 43 can be improved by fitting the base end portion 43*b* of the side cover 43 to the recessed portion 4B1 formed in the pressurizing chamber surface 4B of the flow channel member 4.

Thus, according to the example of FIG. 14, it is possible to further suppress the reduction in printing quality of the recording device 1 due to the static electricity generated during printing.

Note that, in the example of FIG. 14, although the example is illustrated in which the tip portion 43*a* of the side cover 43 is in contact with the diameter expanding portion 94 of the head cover 90C. a portion which the tip portion 43*a* of the side cover 43 contacts is not limited to the diameter expanding portion 94 of the head cover 90C.

Additionally, in the above-described embodiment, although the displacement element 30 using piezoelectric deformation is illustrated as a pressurizing portion, the present invention is not limited thereto, and other elements are applicable as long as liquid in the pressurizing chamber 10 can be pressurized, for example, an element in which the liquid in the pressurizing chamber 10 is heated and boiled to generate pressure, or an element in which micro electro mechanical systems (MEMS) are used may be applicable.

Further, in the above-described embodiment, the cross-section shape of the inner surface 92*a* of the diameter expanding portion 94 in the first side plate 92 is a rounded shape, but the cross-section shape may not be a rounded shape, and, for example, a flared, inclined surface may be formed. Even when such an inclined surface is employed, since the tip opening of the head cover 90 expands outward, the tip edge portion of the first side plate 92 is not in contact with the drive IC 55 housed in the head cover 90. This makes it difficult for the drive IC 55 to be damaged.

Additional effects and variations can be easily derived by a person skilled in the art. Thus, a wide variety of aspects of the present invention are not limited to the specific details and representative embodiments represented and described above. Accordingly, various changes are possible without departing from the spirit or scope of the general inventive concepts defined by the appended claims and their equivalents.

The invention claimed is:

1. A liquid discharge head, comprising:

a head body having a first surface configured to discharge a liquid, and a second surface facing the first surface;

a drive IC configured to drive the head body; and a head cover configured to cover at least the second surface while housing the drive IC, wherein the head cover includes a top plate facing the second surface, and a first side plate that is connected to the top plate and that is in contact with the drive IC, the first side plate having a thickness that is thinner than a thickness of the top plate, and the head cover is a single plate that is bent to define the top plate and the first side plate.

2. The liquid discharge head according to claim 1, further comprising:

an electrical circuit substrate that is housed in the head cover and that includes a connector configured to be used for power supply, wherein the top plate has an opening, and the head cover is fixed by inserting the connector through the opening.

3. The liquid discharge head according to claim 1, wherein the head body includes a flow channel member including a channel into which the liquid flows, and the head cover is disposed separated from the flow channel member.

4. The liquid discharge head according to claim 3, wherein the head cover has a radius in at least an inner surface on the second surface side of the first side plate, and a sealing member is positioned on the inner surface.

5. The liquid discharge head according to claim 3, wherein the flow channel member includes a side cover protruding from the second surface toward the top plate, and the head cover covers the side cover.

6. The liquid discharge head according to claim 5, wherein the side cover has electrical conductivity, and the head cover is in contact with the side cover.

7. The liquid discharge head according to claim 1, wherein a plurality of the drive ICs is arranged side by side in a direction orthogonal to one direction that is a direction from the top plate of the head cover toward the second surface of the head body, and the head cover includes a groove along the one direction between the plurality of the drive ICs in at least any one surface of an outer surface and an inner surface in the first side plate.

8. A recording device, comprising:

the liquid discharge head according to claim 1; and a transport unit configured to transport a recording medium to the liquid discharge head.

9. A liquid discharge head, comprising:

a head body having a first surface configured to discharge a liquid, and a second surface facing the first surface;

a drive IC configured to drive the head body; and a head cover configured to cover at least the second surface while housing the drive IC, wherein the head cover includes a top plate facing the second surface, a first side plate that is connected to the top plate and that is in contact with the drive IC, the first side plate having a thickness that is thinner than a thickness of the top plate, and a second side plate that is connected to the first side plate and that is not in contact with the drive IC, the second side plate having a thickness that is thinner than the thickness of the top plate.

10. The liquid discharge head according to claim 9, wherein in the head cover, the thickness of the first side plate is thicker than the thickness of the second side plate.

11. The liquid discharge head according to claim 9, wherein the head cover has a first side connecting the first side plate and the second side plate, the first side having a first radius;

a second side connecting the top plate and the first side plate; and a third side connecting the top plate and the second side plate, and wherein a length of the second side is longer than a length of each of the first side and the third side.

12. The liquid discharge head according to claim 9, wherein the head cover has a first side connecting the first side plate and the second side plate, a second side connecting the top plate and the first side plate, the second side having a second radius, and a third side connecting the top plate and the second side plate, and wherein a length of the second side is longer than a length of each of the first side and the third side.

13. The liquid discharge head according to claim 12, wherein the head cover has a first radius on the first side and the second radius on the second side, and in the head cover, a size of the first radius is larger than a size of the second radius.

14. A recording device, comprising:

the liquid discharge head according to claim 9; and a transport unit configured to transport a recording medium to the liquid discharge head.

15. A liquid discharge head, comprising:

a head body having a first surface configured to discharge a liquid, and a second surface facing the first surface;

a drive IC configured to drive the head body; and a head cover configured to cover at least the second surface while housing the drive IC, wherein the head cover includes a top plate facing the second surface, and a first side plate that is connected to the top plate and that is in contact with the drive IC, the first side plate having a thickness that is thinner than a thickness of the top plate, and in the head cover, a surface roughness of an outer surface in the first side plate is rougher than a surface roughness of an inner surface in the first side plate.

16. A recording device, comprising:

the liquid discharge head according to claim 15; and a transport unit configured to transport a recording medium to the liquid discharge head.

* * * * *